US008328530B2

(12) United States Patent
Fronzoni

(10) Patent No.: US 8,328,530 B2
(45) Date of Patent: Dec. 11, 2012

(54) TRANSPORTABLE POWER CONTROLLER

(76) Inventor: Gian Carlo Fronzoni, Rapallo (IT)

( * ) Notice: Subject to any disclaimer, the term of this patent is extended or adjusted under 35 U.S.C. 154(b) by 728 days.

(21) Appl. No.: 12/307,435

(22) PCT Filed: Jul. 3, 2007

(86) PCT No.: PCT/EP2007/056693
§ 371 (c)(1),
(2), (4) Date: Jan. 5, 2009

(87) PCT Pub. No.: WO2008/003704
PCT Pub. Date: Jan. 10, 2008

(65) Prior Publication Data

US 2009/0317269 A1 Dec. 24, 2009

(30) Foreign Application Priority Data

Jul. 5, 2006 (IT) ..... GE2006A0070

(51) Int. Cl.

| | |
|---|---|
| ***F04B 53/00*** | (2006.01) |
| ***F04B 17/03*** | (2006.01) |
| ***B62B 1/00*** | (2006.01) |
| ***A45F 4/00*** | (2006.01) |

(52) U.S. Cl. ..... 417/234; 417/411; 280/473.315; 280/47.26; 224/153

(58) Field of Classification Search ..... 417/234, 417/411; 239/152; 280/47.315, 47.26; 224/153
See application file for complete search history.

(56) References Cited

U.S. PATENT DOCUMENTS

| | | | | |
|---|---|---|---|---|
| 3,433,415 | A | 3/1969 | Enssle | |
| 3,881,644 | A * | 5/1975 | Demaline | 224/153 |
| 4,095,726 | A | 6/1978 | Hechler, IV et al. | |
| 4,449,655 | A * | 5/1984 | Germe | 224/153 |
| 4,623,124 | A | 11/1986 | Lewis | |
| 4,748,712 | A * | 6/1988 | DiGiovanni | 15/327.5 |
| 4,999,935 | A * | 3/1991 | Simi et al. | 37/236 |
| 5,125,158 | A | 6/1992 | Casebolt et al. | |
| 5,342,313 | A * | 8/1994 | Campbell et al. | 604/153 |
| 5,678,982 | A * | 10/1997 | Schwaiger | 417/44.2 |
| 6,029,448 | A * | 2/2000 | Hobson | 60/468 |
| 6,524,084 | B2 * | 2/2003 | Neumair | 417/372 |
| 6,530,507 | B2 * | 3/2003 | Oh | 224/153 |
| 6,589,029 | B1 * | 7/2003 | Heller | 417/415 |
| 6,942,468 | B2 * | 9/2005 | Sauerbier et al. | 417/411 |
| 7,448,858 | B2 * | 11/2008 | Neumair et al. | 417/410.1 |
| 2004/0255938 | A1 * | 12/2004 | Shragge | 128/201.27 |

FOREIGN PATENT DOCUMENTS

| | | |
|---|---|---|
| EP | 0 690 230 | 1/1996 |
| GB | 2 000 221 | 1/1979 |
| GB | 2247653 A * | 3/1992 |

* cited by examiner

*Primary Examiner* — Charles Freay
*Assistant Examiner* — Nathan Zollinger
(74) *Attorney, Agent, or Firm* — Stites & Harbison PLLC; Marvin Petry

(57) ABSTRACT

A lightweight, transportable power controller which has a casing, an upper end and a lower end. A reservoir of hydraulic fluid is located in the casing and communicates with the inlet of a pump which is also located in the casing. A direct current electric motor is located above the pump and is driven by a battery which is located in the casing below the reservoir. A rigid frame has a base which supports the bottom of the casing and which has a structure attachable to an operator for carrying the power controller and wheels for moving the power controller along the ground.

6 Claims, 4 Drawing Sheets

TRANSPORTABLE POWER CONTROLLER

The present invention relates to power controllers, and specifically to transportable power controllers.

The term "power controller" generally denotes an electrical controller having a direct-current motor for driving a pump, this pump pressurizing a fluid which is used for driving hydraulic tools. In the field of public protection and assistance, use is made of transportable power controllers for driving tools such as jacks, nut breakers, extractors, torque wrenches and other devices having an operating pressure in the range from about 50 to about 750 bar.

This type of controller must be easily transportable, light, and provided with sufficient battery life to ensure that rapid action can be taken to respond to a given emergency situation; the overall dimensions must be extremely small, maintenance must be unnecessary, and the battery must be very rapidly replaceable, so that the duration of the action can be prolonged.

The present invention therefore proposes a power controller comprising a pump, communicating with a reservoir of oil-hydraulic fluid, and provided with drive means which in turn have supply means, characterized in that the said pump is fitted inside the said reservoir, and is coupled to the said drive means placed above the reservoir, the said pump, the said reservoir, the said drive means and the said supply means being enclosed in a casing which is at least partially removable and/or liftable, and the said casing being coupled to support means enabling the said controller to be transported.

In a preferred embodiment, the said drive means comprise a direct-current electric motor, and the said supply means comprise a cyclic battery which can be removed from the controller and which is provided with means for quick connection to the supply circuit; in particular, the battery is placed under the reservoir which encloses the pump, and the assembly is fitted in a substantially cylindrical containing body, which can be provided with an access hatch for battery replacement. Alternatively, the assembly comprising the reservoir, pump and motor is inserted into a container which is substantially in the shape of a suitcase, and the supply battery is positioned at the side of the said assembly.

In all of the variants described above, the support means providing transportability can be composed of a rigid or semi-rigid frame provided with suitable means for attaching it to the operator's body in the same way as a rucksack or the like. It is also possible to provide idle wheels in a portion of the frame, for transport on flat surfaces, and a telescopic handle which can be pulled out to facilitate transport.

Further advantages and characteristics of the device according to the present invention will be made clearer by the following detailed description of some embodiments of the invention, provided, by way of example and without restrictive intent, with reference to the attached sheets of drawings, in which.

Figure 1:
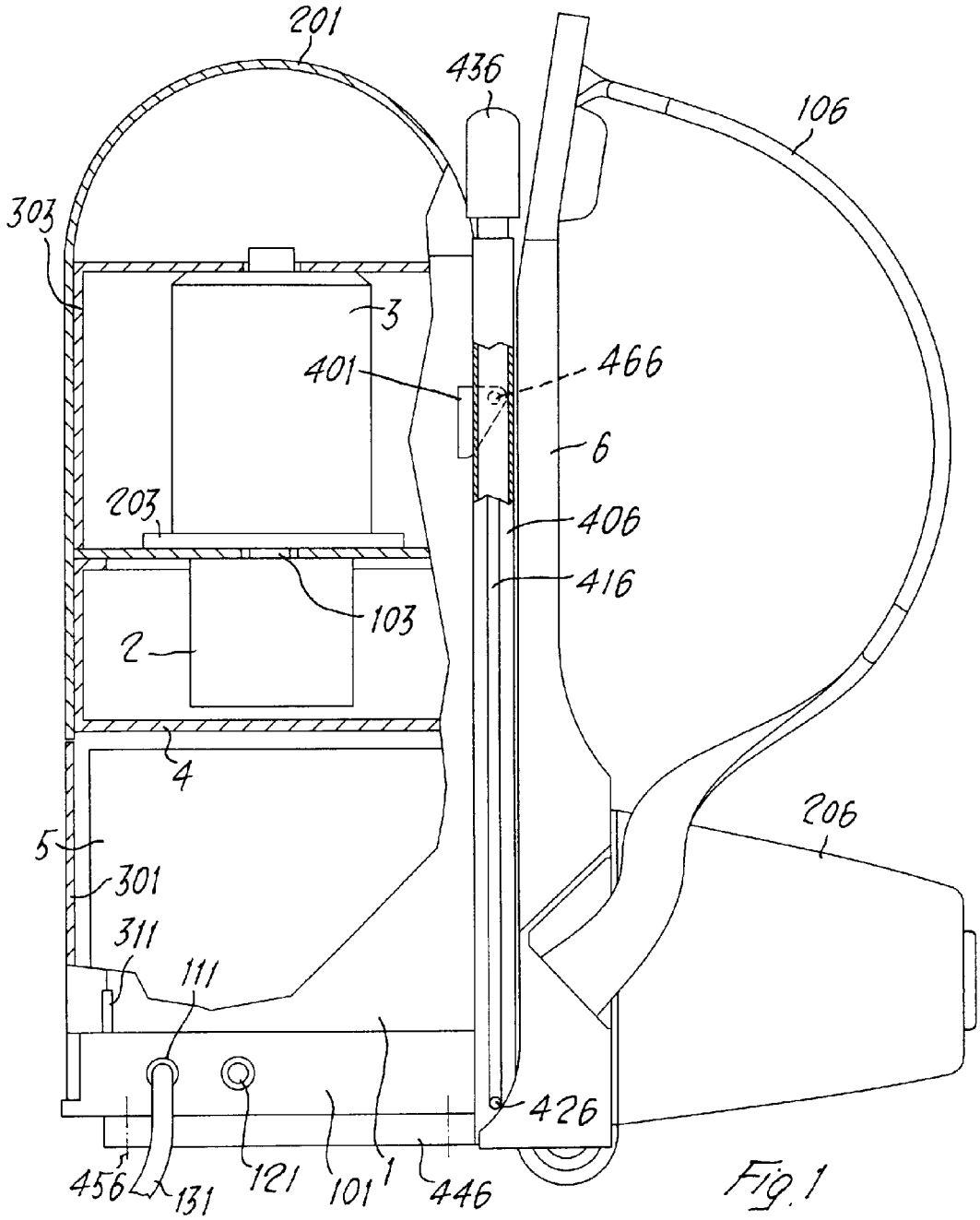
FIG. 1 is a side elevation in partial section of a first embodiment of the controller according to the present invention.

FIG. 1 shows a first embodiment of the device according to the present invention; the number 1 indicates the cylindrical casing which encloses the components of the controller. Inside the casing 1, which has one end placed on a base 101 on which are positioned the start button 121 and the power take-off 111 to which the flexible tube 131 is connected, this tube being connectable in turn to a suitable tool (not shown in the figure). At the end opposite the base 101, the casing has a hemispherical dome 201 made in one piece with the casing; a hatch 301, hinged to the casing at 311, is formed on the lateral wall of the casing 1, in the proximity of the base 101. This hatch 301 provides access to the inside of the casing 1, at the location of the supply battery 5, which can thus be removed and replaced as necessary. The reservoir 4, containing the pump 2 which is coupled by the drive shaft 103 to the motor 3, is positioned above the battery 5; the said motor is positioned inside a casing 303 and is connected to it by means of the coupling flange 203.

The casing 1 is connected to the support/back frame 6 by means of the frame 406 in which the bar 416 carrying the handle 436 is fitted telescopically. The frame comprises projecting arms 446 which are fixed to the base 101 by suitable means 456; the casing 1 also has radially projecting lugs 401, to which the frame 406 is connected by means of pins 466 located on it. The support/back frame 6 is provided with two shoulder straps 106 and a waist strap 206.

Figure 2:
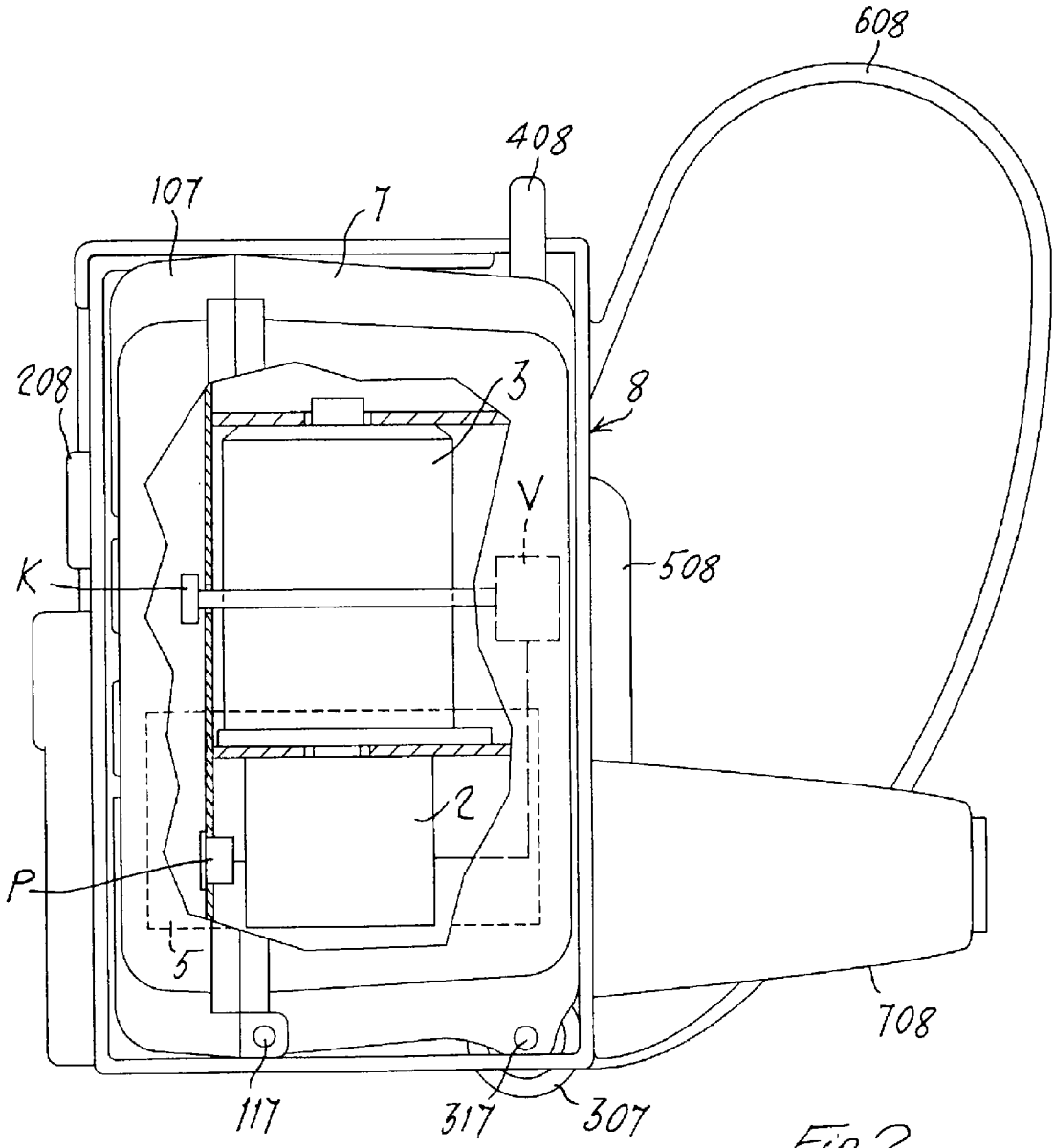
FIG. 2 is a view similar to that of FIG. 1 of a second embodiment of the controller according to the invention.

FIG. 2 shows a second embodiment of the device according to the invention; identical numerals refer to identical parts. As can be seen, the positions of the pump 2, the reservoir 4, the motor 3 and the casing 303 relative to each other are unchanged from those shown in FIG. 1 described above. In this arrangement, however, K is a knob for registering the pressure of the maximum pressure valve V, and P is the pressure gauge. The casing 1 has been replaced by the suitcase 7, provided with a lid 107 hinged at 117; the battery 5 is now positioned at the side of the reservoir/pump/motor assembly, and the suitcase 7 is surrounded by the support 8, which consists of an openable semi-rigid band provided with locking means 208, and having a back frame 508, shoulder straps 608 and a waist strap 708. The suitcase is also provided with wheels 307, pivoting directly at 317 on the suitcase itself, and with a handle 408 joined to a telescopic bar which is similar to that described above, and which is therefore not illustrated more fully here.

Figure 3:
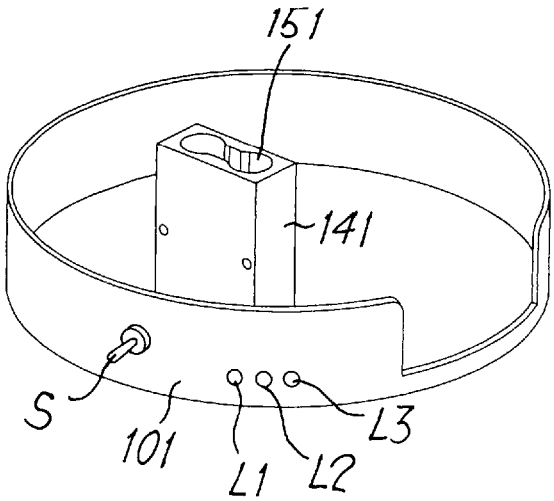
FIGS. 3 and 4 show a detail relating to the embodiment of the device according to the present invention.
Figure 3:
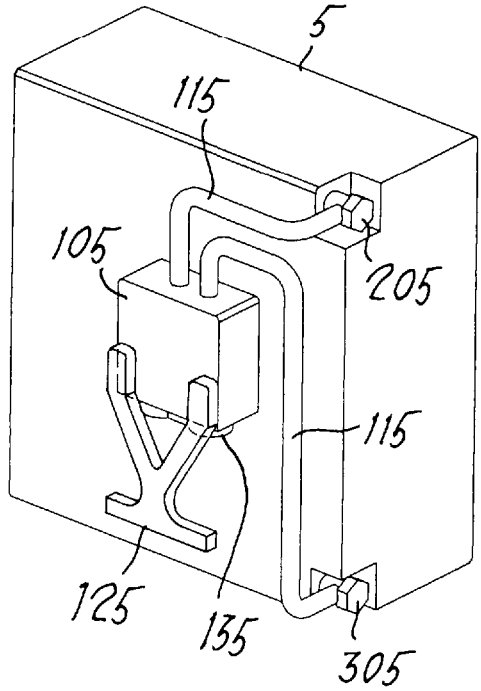
Figure 4:
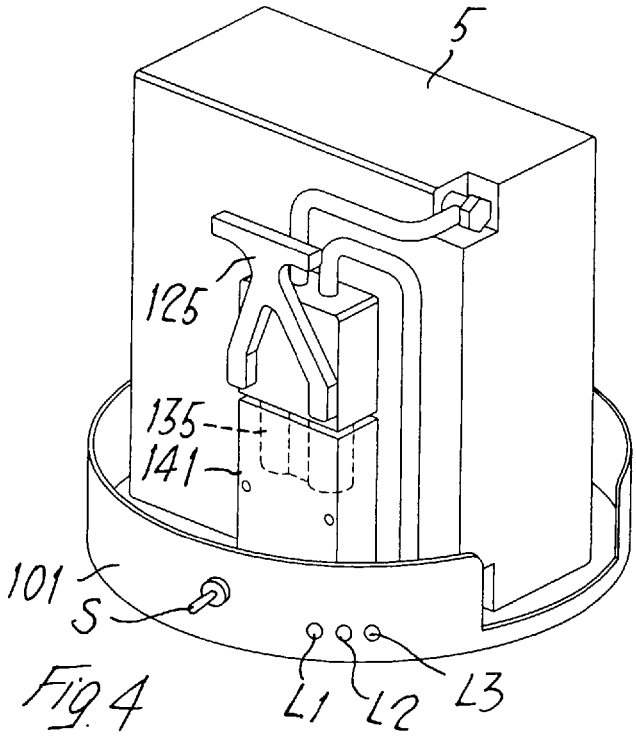

FIGS. 3 and 4 show a variant embodiment of the present invention, particularly in respect of the removability of the supply battery and its positioning in the casing used. In the case which is illustrated, FIG. 3 shows the base 101 of the casing 1, in which is located the supply outlet 141, provided with a shaped cavity 151 for the insertion of the plug of a connector. The battery 5, shown here before its insertion into the base 101, is provided with a connector 105, which comprises two cables 115 connected to the corresponding poles 205 and 305 of the battery 5, a movable plug 135 and an operating lever 125 for the plug 135. When the battery 5 has been positioned in the base 101, the connector 105 is next to the outlet 141, and the plug 135 is inserted into the cavity 151 of the outlet 141 by action on the lever 125. In the base 101 of the casing 1 the switch ON/OFF S is shown, which in its ON condition puts the differently coloured LED's L1, L2 and L3 into communication with a printed circuit board (not shown) sensing the charge level of the battery 5, and this charge indication is displayed through the lighting of one of the three coloured LED ( and for instance green: battery fully charged; yellow: battery half charged and red: battery discharged.

Figure 5:
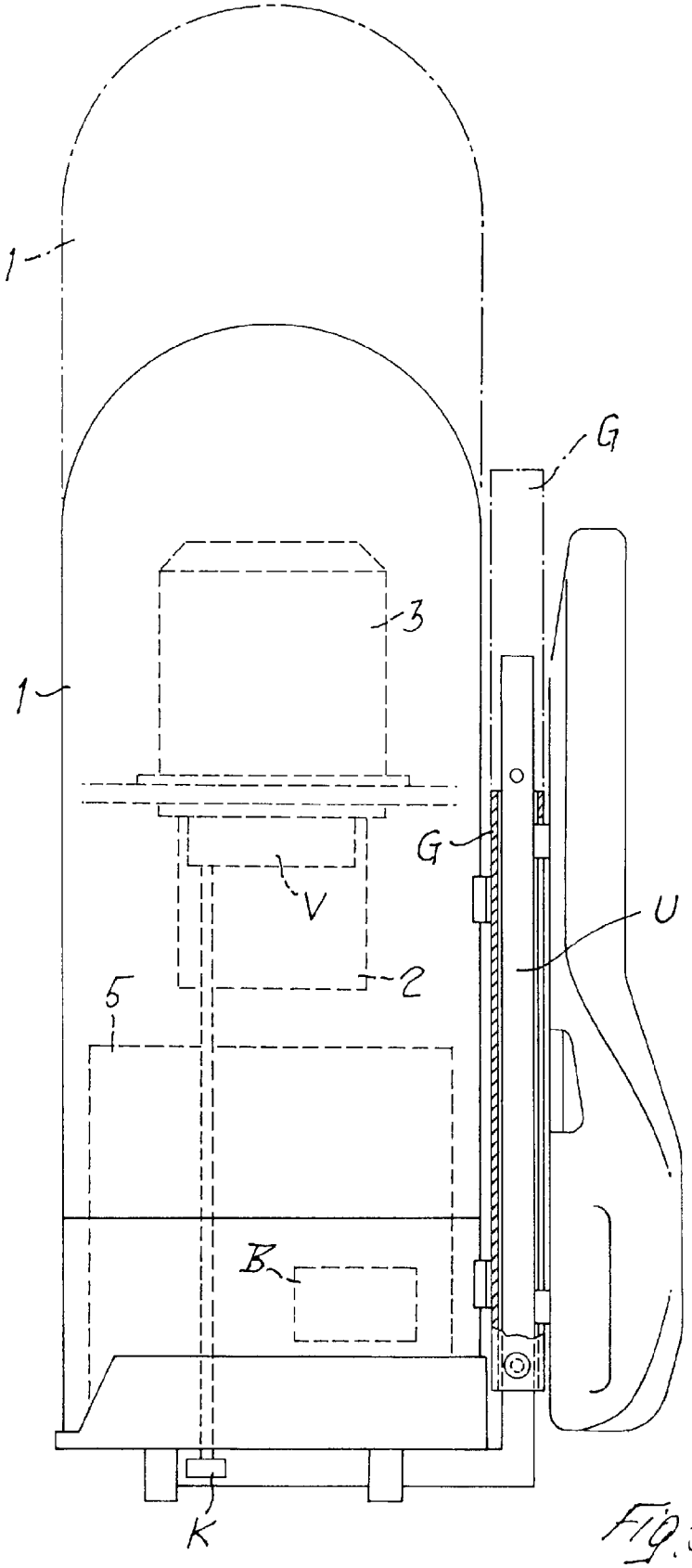
FIG. 5 is a view similar of FIG. 1, of still another embodiment of the present invention.

FIG. 5 shows still another embodiment of the device according to the invention shown in FIG. 1; identical numerals refer to identical parts.

According to this embodiment the cylindrical casing 1 is carried by a tubular guide G telescopically sliding along the upright U connected to the base 101 of the casing. In this manner the casing 1 can be lifted with respect to the base, and stop members are provided for maintaining the casing in, for instance, two lifted positions in order, for instance, to change the battery. In this embodiment, with B the printed circuit board sensing the charge level of the battery 5 is shown. K is the knob for registering the pressure of the maximum pressure valve V.

The operation of the controller according to the present invention will be made clear by the following text. As can be seen, in all embodiments the assembly composed of the pump 2 fitted in the reservoir 4 and the motor 3 is highly compact, and permits a very ordered and simple arrangement of the parts in the controller; furthermore, it should be noted that, in all cases, the battery 5 is positioned so as to be accessible in the best possible way and in the shortest possible time, thus enabling it to be replaced rapidly even during the use of the controller. Advantageously, the motor 3 is provided with a casing 303 which serves to dissipate the heat produced by the motor, thus making it easier for the operator to access the inside of the casing when he needs to replace the battery. The oil reservoir 4 is completely sealed and is mounted on a support, in the embodiment of FIG. 1, which allows the battery 5 to be positioned under the reservoir. The casing 1 can be removed from the base 101 after the lugs 401 have been disengaged from the pins 466. However, the solution shown in FIG. 1, in which a hatch 301 is provided for access to the battery compartment 5, is advantageous.

All embodiments are characterized by excellent transportability, owing to the presence of the shoulder straps and waist strap on the support, as well as the presence of the wheels and the handle with the telescopic bar. The operator can therefore easily transport the controller both on flat and substantially smooth surfaces and in much less favourable conditions.

In the embodiment shown in FIGS. 3 and 4, the aim was to provide an example of a possible efficient embodiment of the connection between the battery and the motor supply circuit; this aspect has a certain importance, because the battery must not only be accessible, but must also be connectable and disconnectable rapidly and with a few simple movements by the operator, while maintaining a high level of security for the connection. In particular, the type of connection shown in FIGS. 3 and 4 also provides a degree of locking of the positioning of the battery 5 in its compartment, thus make the whole supply circuit intrinsically more reliable.

The invention claimed is:

1. A lightweight easily transportable power controller, comprising:

a casing having an upper end and a lower end, a reservoir of hydraulic fluid located in the casing and a hydraulic pump mounted in the casing such that the hydraulic fluid in the reservoir is present at the inlet of the pump, a direct current electric motor positioned above the pump and connected to drive the pump, a battery located in the casing below the reservoir and connected to supply current to the direct current motor, and a rigid frame having a base which holds and supports the bottom of the casing, the frame having a structure attachable to an operator for carrying the power controller and wheels for rolling the power controller along the ground.

2. A power controller according to claim 1, including an access hatch which permits removal of the battery.

3. A power controller according to claim 1, wherein the frame is of a semi-rigid material.

4. A power controller according to claim 1, including a tubular telescopically extendable guide connected to the base and extending upwardly along one side of the casing.

5. A power controller according to claim 4, the guide including stops for limiting the telescopic movement of the guide to at least one lifted position.

6. A power controller according to claim 1, including a pressure gauge for sensing the pressure at the outlet of the pump and an adjusting device for adjusting the pressure at the outlet of the pump.

* * * * *